US008122625B2

(12) United States Patent
Maier-Hunke

(10) Patent No.: US 8,122,625 B2
(45) Date of Patent: Feb. 28, 2012

(54) NAME BADGE

(75) Inventor: Horst-Werner Maier-Hunke, Iserlohn (DE)

(73) Assignee: Durable Hunke & Jochheim GmbH & Co. KG, Iserlohn (DE)

( * ) Notice: Subject to any disclaimer, the term of this patent is extended or adjusted under 35 U.S.C. 154(b) by 162 days.

(21) Appl. No.: 11/992,427

(22) PCT Filed: Sep. 21, 2006

(86) PCT No.: PCT/EP2006/009374
§ 371 (c)(1),
(2), (4) Date: Aug. 24, 2009

(87) PCT Pub. No.: WO2007/033840
PCT Pub. Date: Mar. 29, 2007

(65) Prior Publication Data

US 2010/0000132 A1 Jan. 7, 2010

(30) Foreign Application Priority Data

Sep. 22, 2005 (DE) ..... 10 2005 046 468

(51) Int. Cl.
*A44C 3/00* (2006.01)

(52) U.S. Cl. ..... 40/1.6

(58) Field of Classification Search ..... 40/135, 40/136, 469, 669, 661, 661.04, 661.08
See application file for complete search history.

(56) References Cited

U.S. PATENT DOCUMENTS

| | | | | |
|---|---|---|---|---|
| 5,067,265 | A * | 11/1991 | Harms | 40/1.5 |
| 5,283,966 | A * | 2/1994 | Rader et al. | 40/1.5 |
| 5,361,903 | A * | 11/1994 | Thiele | 206/403 |
| 5,613,602 | A * | 3/1997 | Lage et al. | 206/232 |
| 5,619,816 | A * | 4/1997 | Ellison | 40/738 |
| 5,664,292 | A * | 9/1997 | Chen | 24/3.11 |
| 6,170,181 | B1 * | 1/2001 | Groner | 40/1.6 |
| 6,810,529 | B1 * | 11/2004 | Reilly et al. | 2/69 |
| 2003/0200690 | A1 * | 10/2003 | Galloway | 40/779 |
| 2004/0163990 | A1 * | 8/2004 | Begim | 206/472 |
| 2007/0022794 | A1 * | 2/2007 | Maier-Hunke | 70/456 R |
| 2007/0089343 | A1 * | 4/2007 | Goldman | 40/737 |

FOREIGN PATENT DOCUMENTS

| | | |
|---|---|---|
| DE | 89 01 912 U1 | 6/1989 |
| DE | 19738878 | 3/1999 |
| EP | 0 608 043 | 7/1994 |
| EP | 1174846 | 1/2002 |
| FR | 2605127 | 4/1988 |

* cited by examiner

*Primary Examiner* — Paul N Dickson
*Assistant Examiner* — Shin Kim
(74) *Attorney, Agent, or Firm* — Mark P. Stone

(57) ABSTRACT

In order to economically manufacture name badges with a comparatively high stiffness, it is proposed that they are produced as one-part injection moulded components, each with a curved front part (1) and a similarly curved rear part (2), which is connected to the front part (1) by pivot bearings (4) and both the front part (1) and the rear part (2) are provided with circumferential ridges (6, 7) which are orientated in the same direction when the front and rear parts (1, 2) are in the closed state.

21 Claims, 7 Drawing Sheets

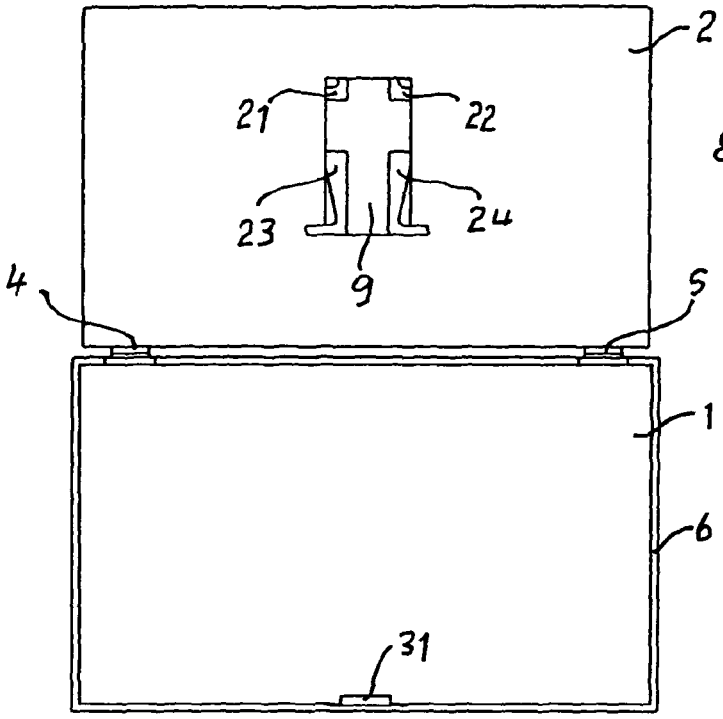
FIG..1
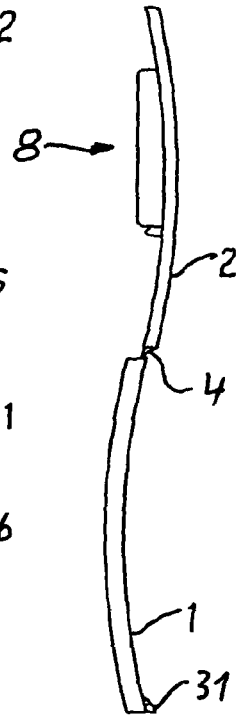
FIG..2
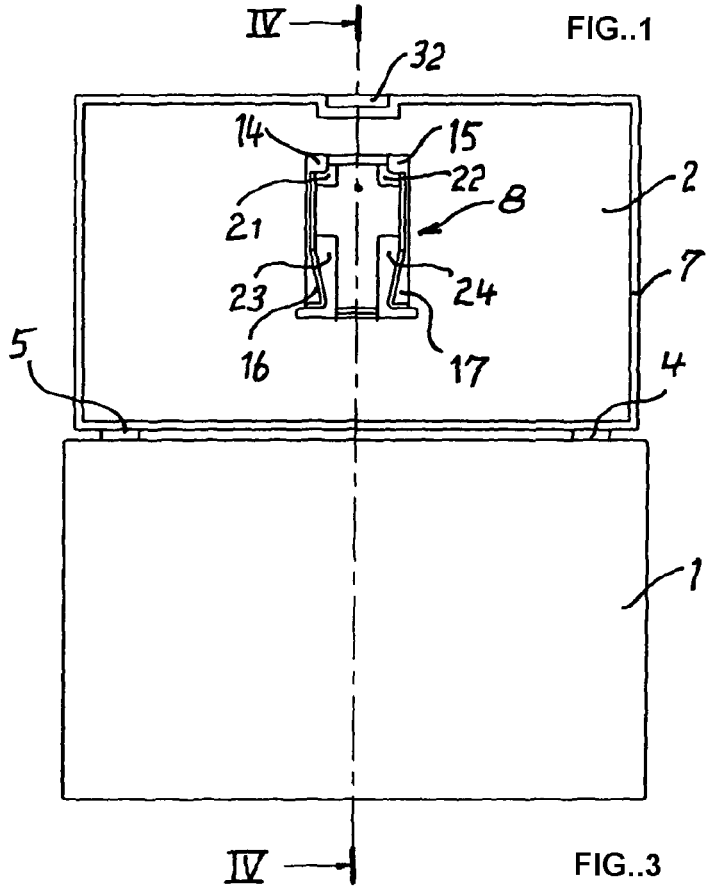
FIG..3
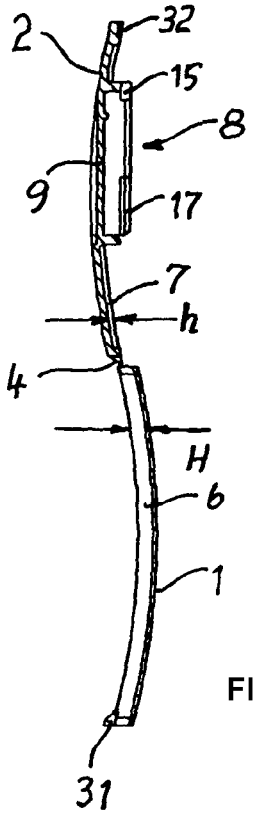
FIG..4

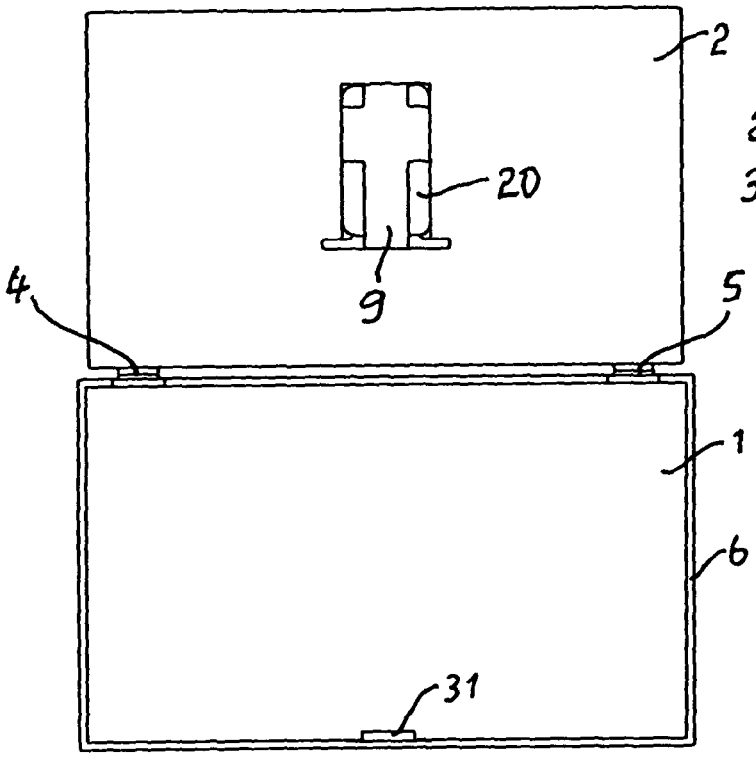
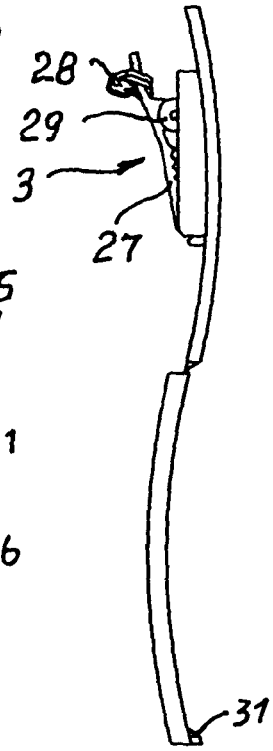
FIG..6
FIG..5
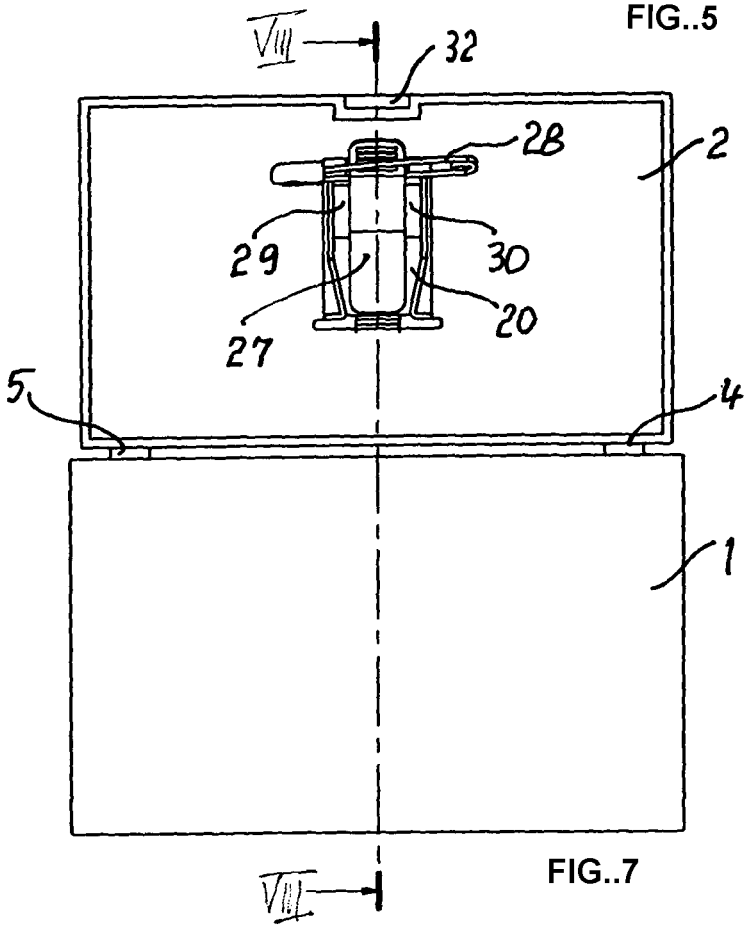
FIG..7
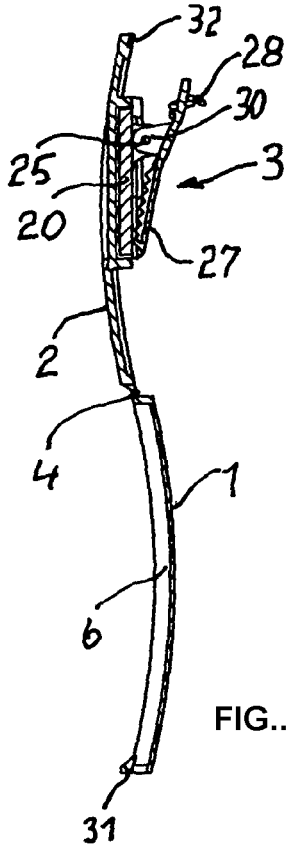
FIG..8

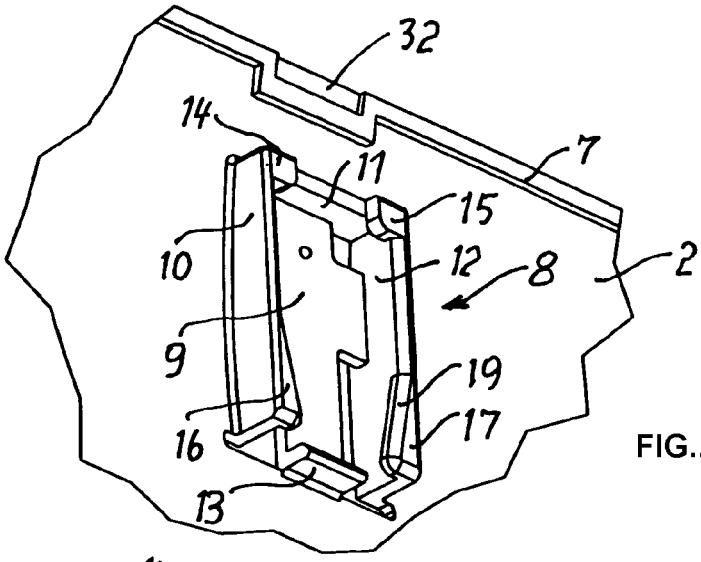
FIG..9
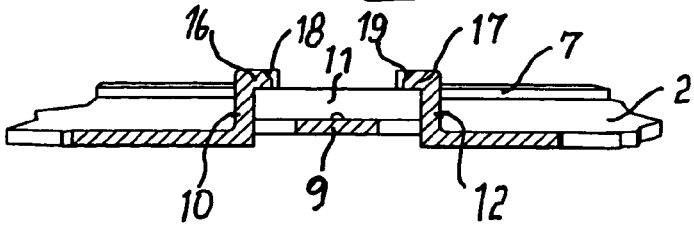
FIG..11
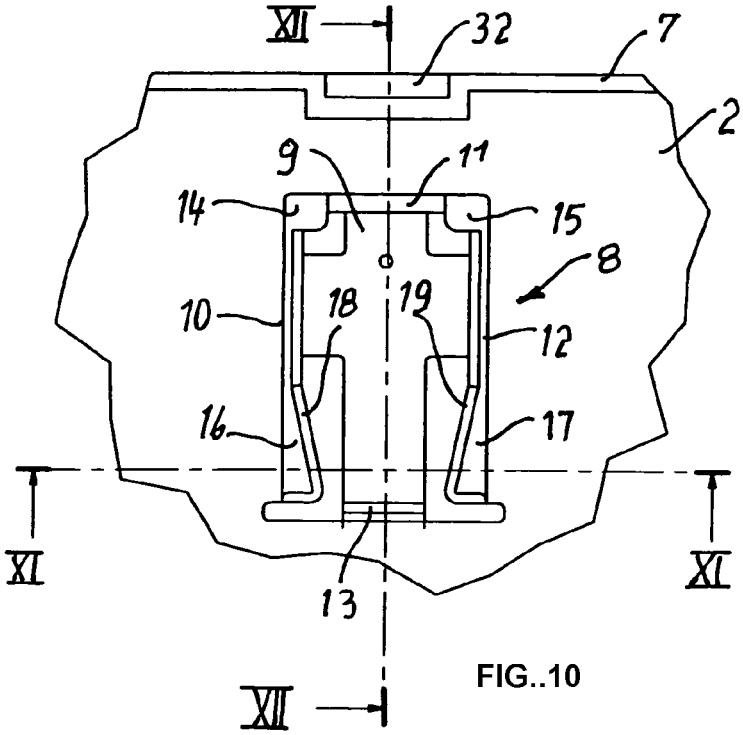
FIG..10
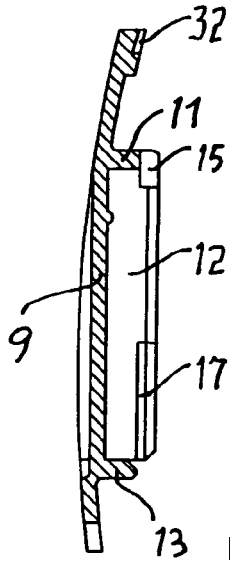
FIG..12

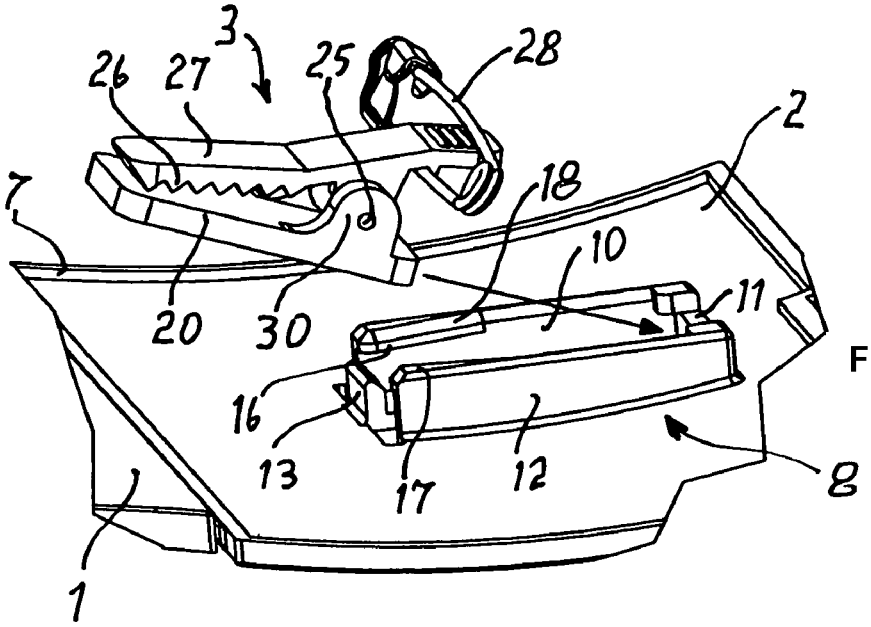
FIG..13
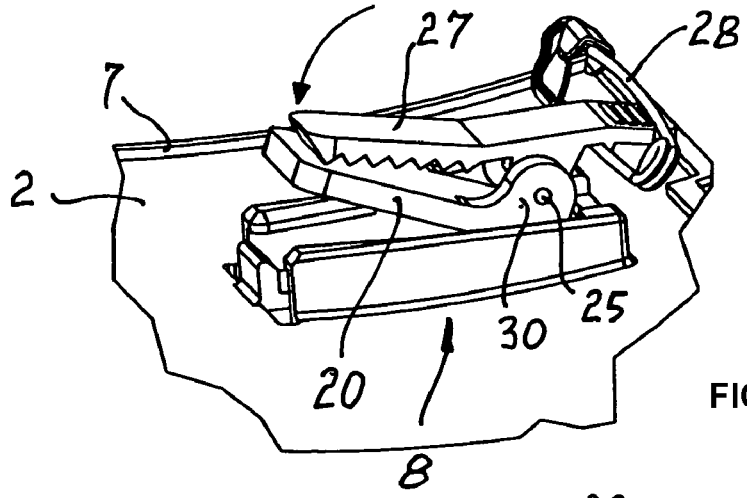
FIG..14
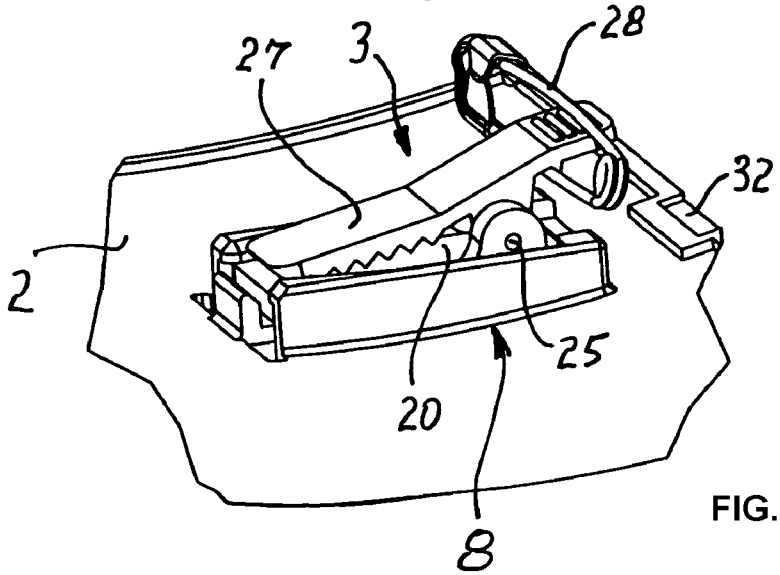
FIG..15

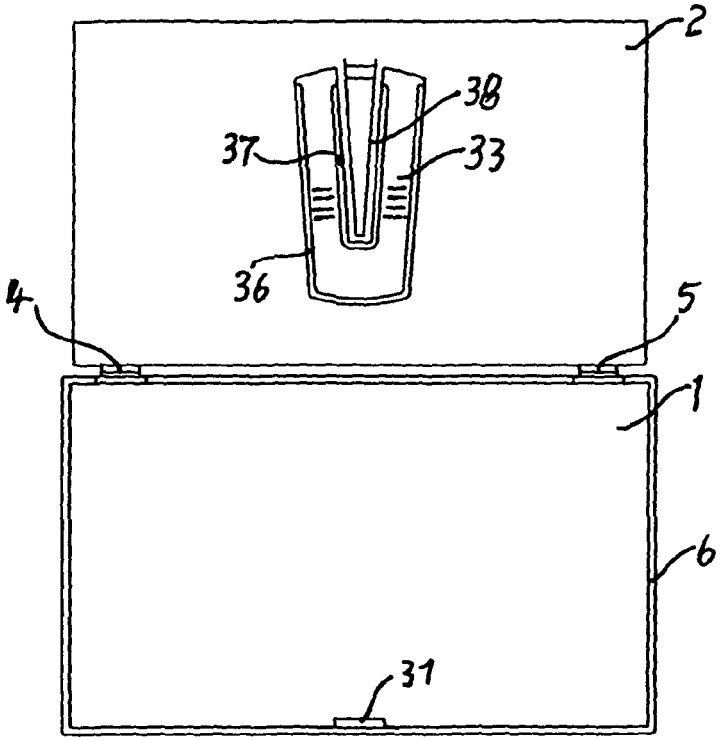
FIG..16
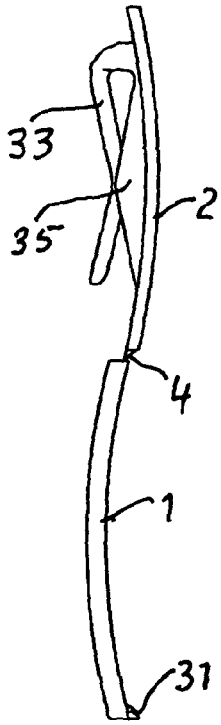
FIG..17
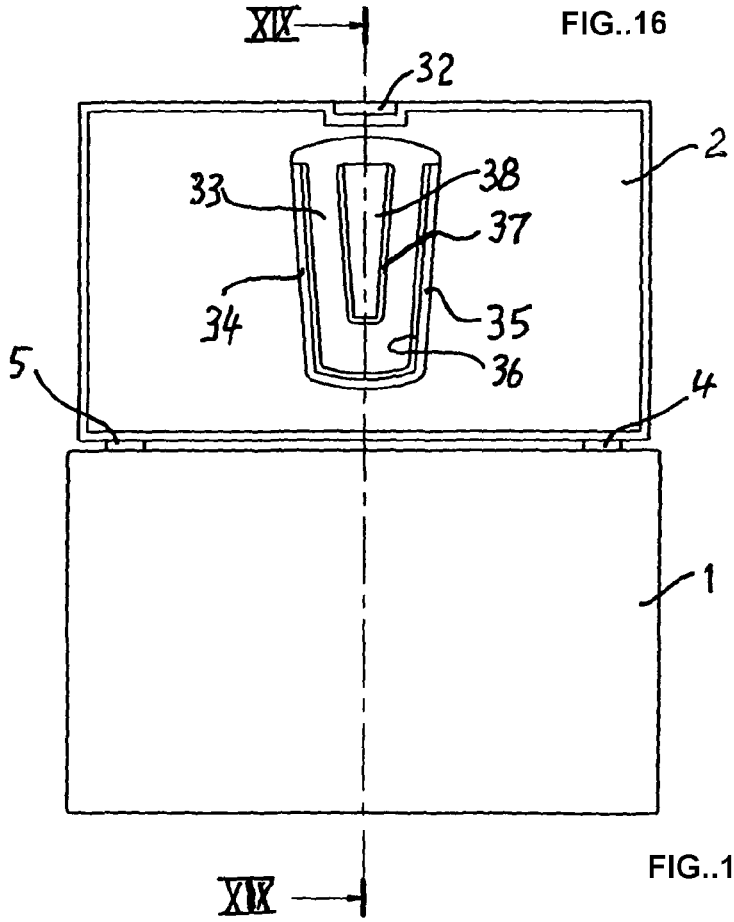
FIG..18
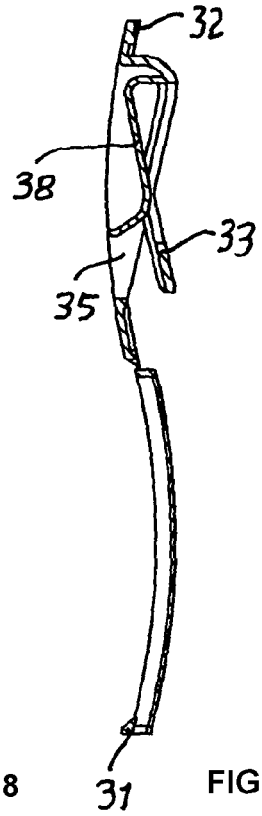
FIG..19

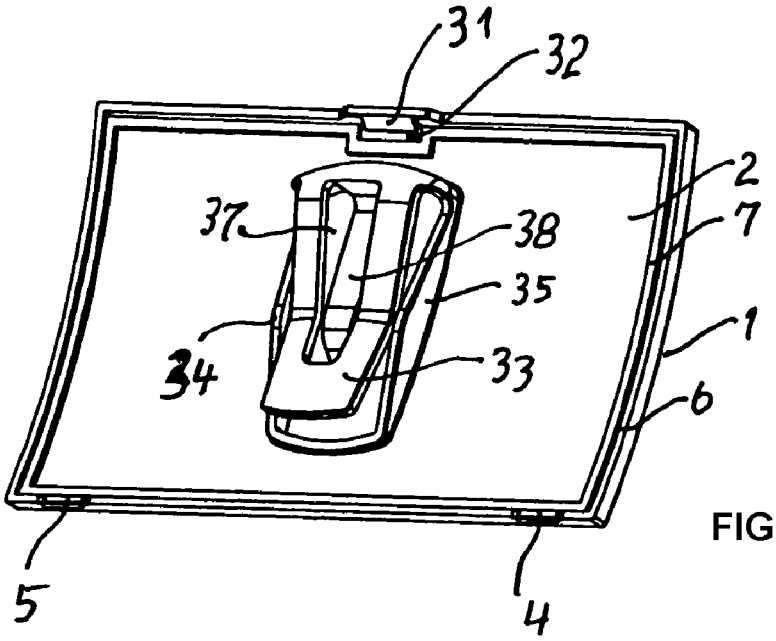
FIG..22
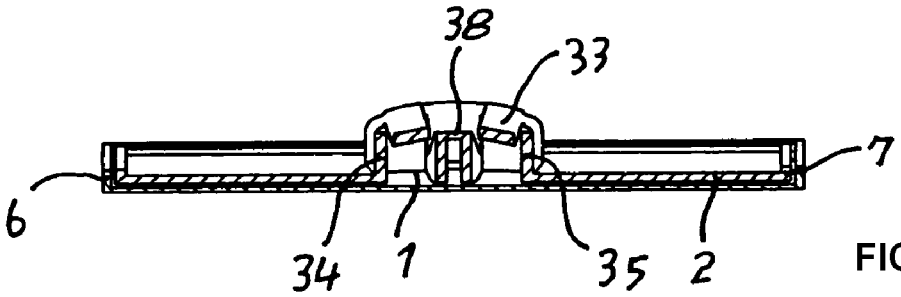
FIG..21
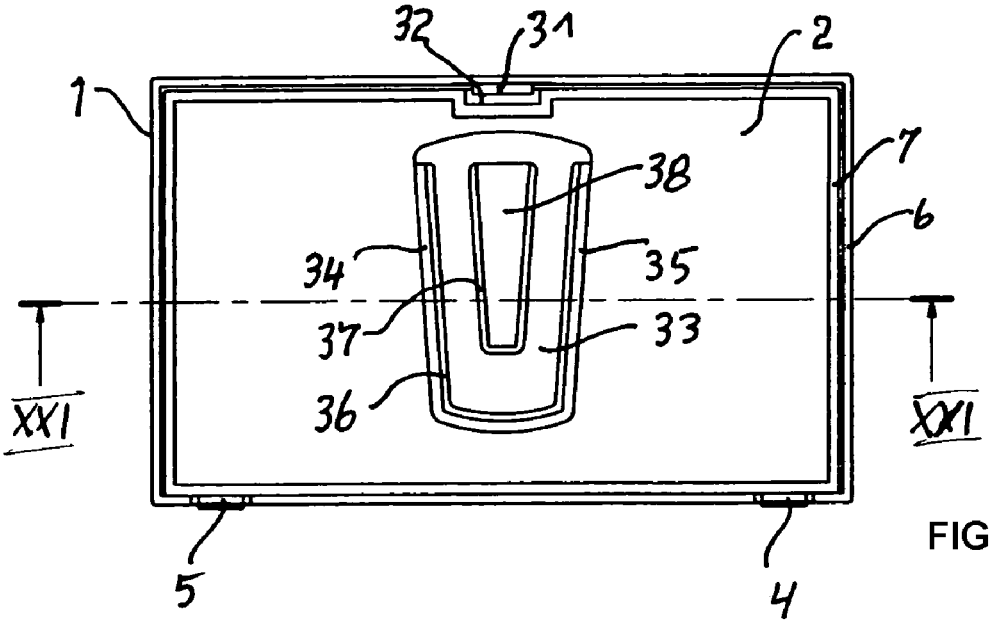
FIG..20

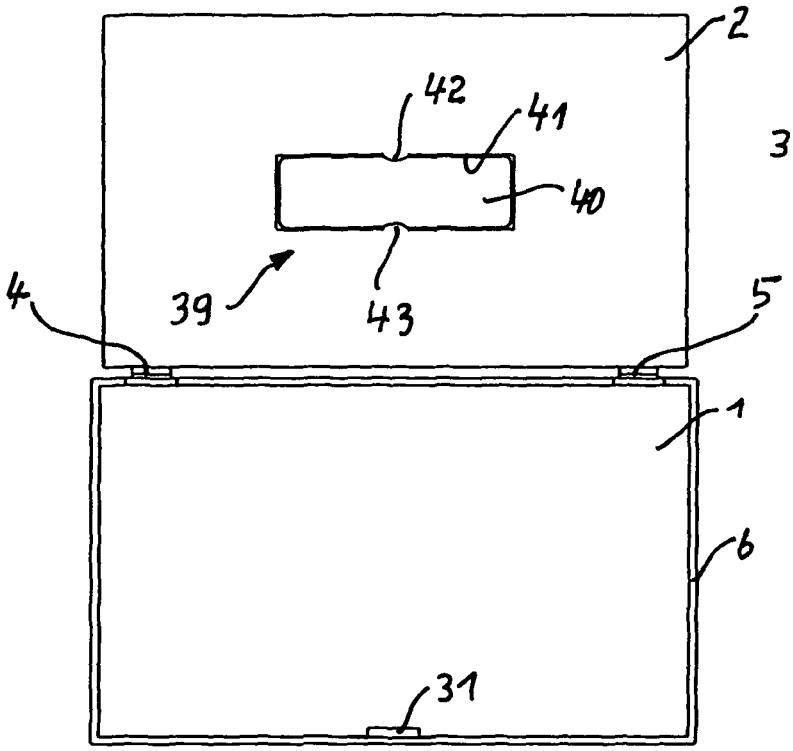
FIG..23
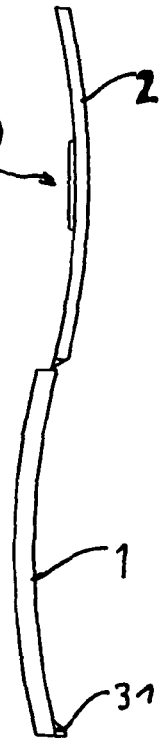
FIG..24
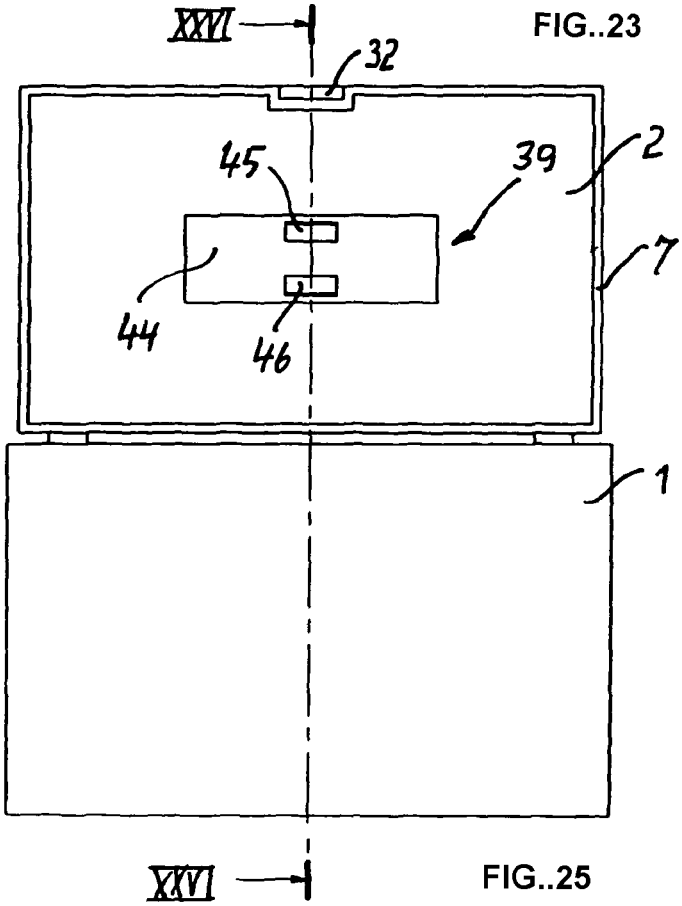
FIG..25
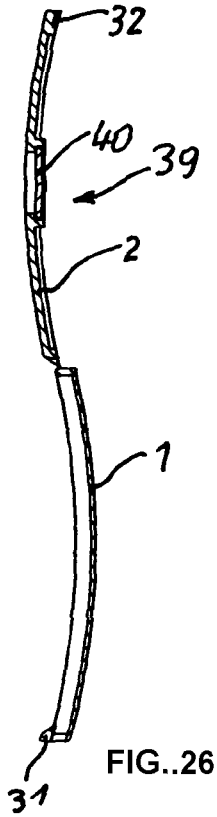
FIG..26

NAME BADGE

TECHNICAL FIELD

The invention relates to a name badge with a front part and a rear part in which the front part and the rear part form a receptacle for a label.

STATE OF THE ART

Name badges are mass-produced articles which are offered in various embodiments and which are used in particular at conferences. If each is to be used only once, then they must be primarily economical. The most popular name badges are not only classified as mass-produced, but also as cheap articles, for example of the type described in DE 89 01 912 U1, i.e. name badges, which are manufactured by two or three bending processes from a transparent strip of rigid sheet and have an attachment element on their rear wall. Due to the technology used in their manufacture, these name badges are open on their oppositely situated narrow sides and consequently offer no absolute guarantee of secure seating of the label which is normally inserted into the name badge from the side and which bears the user's name or function.

In particular for cases in which name badges are intended for a longer term use, irrespective of whether this is by employees in factories or sales personnel in shops, a second group of name badges has been developed, which compared to the previously described name badges possess a higher stability and with appropriate design offer secure seating of the label. A name badge of this second group is known from EP 0 608 043 B1. It consists of at least two parts, of which the rear part, produced as an injection moulded component, forms a frame consisting of an opaque material for the accommodation of the label, whereas the front part produced as a punched part consists of a transparent cover which can be clipped into the frame. With this name badge the obtained advantages of increased stability and captive accommodation of the label are however achieved with manufacturing costs which lie significantly above the costs for the manufacture of name badges of the first group. Added to that, they can only be sold practically in the assembled state and consequently have to be first disassembled by the user to fit the label bearing a name and then reassembled again.

Finally, from DE 197 38 878 A1 a marking label holder is known, which is formed as a one-part injection moulded component and consists of a front part and a rear part, which is connected to the front part by a film hinge. In the region of their edges both the front part and the rear part have circumferential ridges. Since the ridges in the closed state of the two parts point in different directions, the front part and the rear part enclose a box type cavity, which due to its dimensions offers no guarantee of a precisely defined seating of the marking label and consequently excludes the use of the marking label holder as a name badge.

DESCRIPTION OF THE INVENTION

The object of the invention is to provide a name badge of the type under consideration, which can be manufactured economically and used easily and in addition has increased stability compared to name badges of the first group. The above object is solved according to the invention by a name badge which is characterised in that the front part is connected to the rear part by at least one film hinge forming a pivot bearing and both above-mentioned parts are produced as a one-part injection moulded component, in that the sections of which forming the front part and rear part in the closed state are held together by a latching connection, in that the front part and the rear part are slightly curved to increase their stiffness, in that in the region of its edges the front part is provided with a circumferential ridge which forms a frame into which the rear part can be folded, in that in the region of its edges the rear part is also provided with a circumferential ridge and in that in the closed state both ridges of the front part and rear part are orientated in the same direction.

As with the name badges of the first group, but differently to the name badges of the second group, the front part and the rear part of the name badge according to the invention consist of one piece. Using the name badge according to the invention is extraordinarily convenient, because the user simply places the label between the two parts of the name badge and then closes them together. Due to the fact that in the closed state of the front and rear parts the circumferential ridges project in the same direction over the curved main sections of the front and rear parts, a close fit is produced between the inner wall of the front part and the wall of the rear part orientated to this wall, which means that secure seating of the paper insert in the known manner with the name of the wearer of the name badge is ensured. Other than that, the curved shape of the name badge not only increases the stiffness of the badge, but also reduces disturbing light reflections.

The use of the injection moulding method for the manufacture both of the front and rear parts also opens up a range of interesting and simply realisable design possibilities. In particular it facilitates equipping the rear part with an integral mounting for means of attaching the name badge to an item of clothing. A mounting of this nature can for example be produced as a cavity fitted with snap cams for accepting a steel plate, which facilitates careful attachment of the name badge to an item of clothing with the aid of a magnet.

Particularly popular are attachment devices for name badges, which have a base with two cheeks arranged spaced from one another, in which a pivot axle for a double-arm clamping element, provided with retaining teeth and subject to the action of a spring, is supported, which, in the case of so-called combination clamps is also used to carry a pin. With known name badges, attachment devices of this nature are joined to the rear wall of the respective name badge using a suitable adhesive. This type of manufacture of name badges always leads to flawless results if suitable adhesive is found for the respective material pair, wherein practically only quick-acting adhesive can be considered due to production reasons. If it is considered that also quick-acting adhesives need a certain time to bond and are not normally free of solvent then it is found that, on the grounds of cost savings and also environmental pollution due to the release of solvent, it is preferable to seek ways, which render an adhesive process dispensable. The adhesive process can be avoided if the mounting is produced as a frame, which is accessible from the rear side of the rear part and integrated into the rear part, for the accommodation of the base of the attachment device, wherein the frame preferably at least partially encloses the base and in the region of the base located outside of the cheeks is provided with holding down clamps for the base, of which at least some are elastically deformable.

Finally, it has been found to be particularly economical and efficient if an integral, hook- shaped Clamping limb which can be used as an attachment element is arranged in the region of a recess in the rear part bordered by side ridges and which practicably has a slot into which an abutment, which is formed by an extension arm of the rear part, protrudes to increase the clamping effect.

Further details of the name badge according to the invention are given in the following description of several embodiments of the invention illustrated in the included drawing.

BRIEF DESCRIPTION OF THE DRAWINGS

The following are shown:

FIG. 1 the plan view onto the inner side of an open first name badge with a mounting for a combination clamp, FIG. 2 the side view of the name badge according to FIG. 1, FIG. 3 the plan view onto the outer sides of the open name badge according to FIGS. 1 and 2, FIG. 4 a section along the line IV-IV through the name badge according to FIG. 3, FIG. 5 a plan view corresponding to FIG. 1 onto the inner side of an open name badge, provided with a combination clamp, according to FIGS. 1 to 4, FIG. 6 the side view of the name badge according to FIG. 5, FIG. 7 a plan view corresponding to FIG. 3 onto the outer sides of the name badge, provided with a combination clamp, according to FIG. 5, FIG. 8 a section along the line VII-VII in FIG. 7, FIG. 9 the perspective view in enlarged scale of the mounting for the combination clamp used for the name badge according to the FIGS. 1 to 8, FIG. 10 the plan view onto the mounting according to FIG. 9, FIG. 11 a section along the line XI-XI in FIG. 10, FIG. 12 a section along the line XII-XII in FIG. 10, FIG. 13 insertion of a combination clamp into the mounting according to FIGS. 9 to 12, FIG. 14 the pivoting of the combination clamp into its intended position, FIG. 15 the end position of the captive combination clamp arranged in the mounting, FIG. 16 the plan view of the inner sides of an open second name badge, the rear part of which is provided with an integral means of attachment, FIG. 17 the side view of the name badge according to FIG. 13, FIG. 18 the plan view onto the outer sides of the open name badge according to FIGS. 16 and 17, FIG. 19 a section along the line XIX-XIX in FIG. 18, FIG. 20 the plan view onto the rear part of the closed name badge according to FIGS. 16 to 19, FIG. 21 a section along the line XXI-XXI in FIG. 20, FIG. 22 the perspective view of the closed name badge according to FIGS. 16 to 21, FIG. 23 the plan view onto the inner sides of an open third name badge which can be attached with the aid of a magnet, FIG. 24 the side view of the name badge according to FIG. 23, FIG. 25 the plan view onto the outer sides of the open name badge according to FIGS. 23 and 24 and FIG. 26 a section along the line XXVI-XXVI in FIG. 25.

In FIGS. 1 to 15 the front part of a first embodiment of a name badge is designated with 1 and the rear part of the said embodiment is designated with 2. An attachment device 3 in the form of a known, so-called combination clamp is used to attach the said badge to an item of clothing. The front part 1 is connected to the rear part 2 by two pivot bearings 4 and 5 formed by film hinges. The front part 1, rear part 2 and the pivot bearings 4, 5 are composed of one piece, formed as an injection moulded component.

To increase the stiffness of the name badge both the front part 1 and also the rear part 2 are slightly curved and are in addition provided with circumferential ridges 6 or 7, wherein the height H of the ridge 6 is greater than the height h of the ridge 7 in order to prevent protrusion of the ridge 7 beyond the ridge 6 when the name badge is closed. The ridge 6 of the front part 1 here forms a frame not only for the rear part 2, but also for a label, not shown, which consequently cannot be lost. In the closed state of the front and rear parts (1, 2) both ridges are orientated in the same direction, that is to the rear side of the badge, i.e. to the item of clothing of the wearer of the name badge.

An integral mounting 8, the structure of which can be seen from FIGS. 9 to 12, is used for the attachment of the attachment device 3, formed as a combination clamp, to the rear part 2. The mounting 8 has a flat base 9, to which the side walls 10, 11 and 12, which protrude beyond the inner side of the rear part 2, and a limit stop 13 are connected. At the transitions between the wall 11 and the walls 10 and 12 there are two holding down clamps 14 and 15, which together with two other holding down clamps 16, 17 ensure the secure seating of the attachment device 3 in the mounting 8. The holding down clamps 16 and 17 have oblique guide areas 18, 19, which enable the base 20 to be clipped into the mounting 8, provided that the material used for the manufacture of the name badge has sufficient elasticity. The base 9 has the shape of a cross, i.e. for reasons of injection moulding it has openings 21, 22, 23 and 24 in the region of the holding down clamps 14 to 17.

The assembly of the attachment device 3 is illustrated for greater clarity in FIGS. 13 to 15. FIGS. 13 to 15 show that the attachment device 3 has a double-arm clamping element 27, supported on a pivot axle 25 and provided with retaining teeth 26, which carries a pin 28 at its end orientated away from the retaining teeth 26. The retaining teeth 26 of the clamping element 27 are pressed against the base 20 under the action of a spring which is not shown. With the attachment device 3 in the clipped-in state the holding down clamps 21 to 24 are located against sections of the base 20, which are located outside of the cheeks 29, 30, in which the pivot axle 25 for the clamping element 27 is supported.

To ensure that the closed parts 1 and 2 keep together a latching connection is used which consists of a hook 31 and a cavity-shaped recess 32, behind which the tip of the hook 31 can engage.

Instead of the commercially available attachment device 3 offering two methods of attachment, the name badge illustrated in FIGS. 16 to 20 has an integral clamping limb 33, which can be used as an attachment element, formed as a type of hook and to which side ridges 34, 35 are assigned, which delimit a recess 36 in the region of which the clamping limb 33 is arranged. An assembly process following the injection moulding process, as with the previously described name badge, is in other words no longer required. During the attachment of the second name badge to an item of clothing, the material of the item of clothing is firmly clamped between the clamping limb 33 and the side ridges 34, 35. In the case of dispensing with the side ridges 34, 35 or also increasing the clamping effect it is found to be practicable to provide the clamping limb 33 with a central slot 37 into which an abutment 38 with a U-shaped cross-section, recognisable in FIG. 21, protrudes. Other than that the structure of the second name badge corresponds to the structure of the first name badge so that identical reference numerals can be assigned to the matching parts.

Finally, in FIGS. 23 to 26 a further embodiment of a name badge is illustrated, which can be attached in a known manner with the aid of a magnet In this case the rear part is provided with an integral mounting 39 for accommodating a steel plate 40. The mounting 39 is formed by a cavity 41, which has two snap cams 42 and 43, in the region of which the base 44 of the cavity 41 is, due to injection moulding reasons, provided with two holes 45 and 46.

The invention claimed is:

1. Name badge with a front part (1) and a rear part (2), in which the front part (1) and the rear part (2) form a receptacle for a label, characterised in that the front part (1) is connected to the rear part (2) by at least one film hinge forming a pivot bearing (4, 5) and both above-mentioned parts are formed as a one-part injection moulded component, the sections of which forming the front part (1) and the rear part (2) are held together in the closed state by a latching connection (31, 32), in that the front part (1) and the rear part (2) are slightly curved to increase their stiffness, in that the front part (1) in the region of its edges is provided with a circumferential ridge (6), which forms a frame, into which the rear part (2) can be folded, in that the rear part (2) in the region of its edges also has a circumferential ridge (7) and in that both ridges (6, 7) face in the same direction in the closed state of the front and rear parts (1, 2).

2. Name badge according to claim 1, characterised in that the height (h) of the circumferential ridge (7) of the rear part (2) is smaller than the height (H) of the circumferential ridge (6) of the front part (1).

3. Name badge according to claim 1, characterised in that the latching connection (31, 32) is arranged on the edge of the front part (1) and the rear part (2) facing away from the pivot bearing (4, 5).

4. Name badge according to claim 1, characterised in that it has on one of its longitudinal edges at least two pivot bearings (4, 5) arranged spaced from one another.

5. Name badge according to claim 1, characterised in that the rear part (2) is provided with an integral mounting (8, 39) for means of attaching the name badge to an item of clothing.

6. Name badge according to claim 5, characterised in that the mounting (39) is formed as a cavity (41) provided with snap cams (42, 43) for the accommodation of a steel plate (40).

7. Name badge according to claim 5, characterised in that the mounting (8) is formed as a frame, accessible from the rear side of the rear part (2), for accommodating a base (20) of an attachment device (3).

8. Name badge according to claim 7 with an attachment device, which has a base (20) with two cheeks (29, 30), spaced from one another, in which a pivot axle (25) is supported for a double-arm clamping element (27), said clamping element (27) being fitted with retaining teeth (26) and subject to the action of a spring, characterised in that the mounting (8) is produced as a type of frame (10-13) at least partially enclosing the base (20) of the attachment device (3), the said frame being provided with the retaining clamps (14-17) for the base (20) in the region of the base (20) outside of the cheeks (29, 30), with at least some of said retaining clamps being elastically deformable.

9. Name badge according to claim 8, characterised in that one of the lateral sides of the frame (10-13) is formed as a limit stop (13), which can be brought into contact with one of the face sides of the base (20) of the attachment device (3) with the said face side extending perpendicular to the cheeks (29, 30).

10. Name badge according to claim 9, characterised in that the region of the ends of the longitudinal sides of the frame (10-13) orientated towards the limit stop (13) flexible retaining clamps (16, 17) are arranged, which taper in the direction of the ends of the longitudinal sides orientated away from the limit stop (13).

11. Name badge according to claim 8, characterised in that at least one further retaining clamp (14, 15) is arranged in the region of the end of the frame (10-13) orientated away from the limit stop (13).

12. Name badge according to claim 8, characterised in that the base (9) of the mounting (8) has openings (21-24) in the region of the retaining clamps (14-17).

13. Name badge according to claim 12, characterised in that the base (9) of the mounting (8) essentially has the shape of a cross.

14. Name badge according to claim 1, characterised in that an integral hook-shaped clamping limb (33), which can be used as attachment element, is arranged in the region of a recess (36) on the rear part (2).

15. Name badge according to claim 14, characterised in that the recess (36) of the rear part (2) is delimited by side ridges (34, 35).

16. Name badge according to claim 14, characterised in that the hook-shaped clamping limb (33) has a slot (37) into which an abutment (38) protrudes to increase the clamping effect.

17. Name badge according to claim 16, characterised in that the abutment (38) is formed by an extension arm of the rear part (2).

18. Name badge according to claim 17, chacterised in that the extension arm has a U-shaped cross-section.

19. Name badge according to claim 16, characterised in that the sides of the clamping limb (33) and the abutment (38) orientated towards one another have ribbing to improve the seating of the name badge.

20. Name badge according to claim 2, characterised in that the latching connection (31, 32) is arranged on the edge of the front part (1) and the rear part (2) facing away from the pivot bearing (4, 5).

21. Name badge with a front part (1) and a rear part (2), in which the front part (1) and the rear part (2) form a receptacle for a label, characterised in that the front part (1) is connected to the rear part (2) by at least one film hinge forming a pivot bearing (4, 5) and both above-mentioned parts are formed as a one-part injection moulded component, the section of which forming the front part (1) and the rear part (2) are held together in the closed state by a latching connection (31, 32), in that the front part (1) and the rear part (2) have a curved shape to increase their stiffness, in that the front part (1) in the region of its edges is provided with a circumferential ridge (6), which forms a frame, into which the rear part (2) can be folded, in that the rear part (2) in the region of its edges also has a circumferential ridge (7) and in that both ridges (6, 7) are oriented in the same direction in the closed state of the front and rear parts (1, 2).

* * * * *